US005446443A

United States Patent [19]

Ishii

[11] Patent Number: 5,446,443

[45] Date of Patent: Aug. 29, 1995

[54] FIRE-ALARM SYSTEM

[75] Inventor: Kenji Ishii, Tokyo, Japan

[73] Assignee: Nohmi Bosai, Ltd., Tokyo, Japan

[21] Appl. No.: 41,322

[22] Filed: Mar. 31, 1993

[30] Foreign Application Priority Data

Apr. 9, 1992 [JP] Japan ..... 4-133065

[51] Int. Cl.[6] ..... G08B 26/00

[52] U.S. Cl. ..... 340/505; 340/825.06; 340/825.07; 340/310.01; 340/588

[58] Field of Search ..... 340/505, 518, 506, 510, 340/511, 514, 825.06, 825.21, 310 A, 310 R, 825.07, 825.13, 588, 310.01

[56] References Cited

U.S. PATENT DOCUMENTS 4,825,196 4/1989 Morita ..... 340/505
4,899,131 2/1990 Wilk et al. ..... 340/505

FOREIGN PATENT DOCUMENTS

GB2141276A 12/1984 United Kingdom .
GB2173618A 10/1986 United Kingdom .
WO87/03406 6/1987 WIPO .
WO89/04032 5/1989 WIPO .

*Primary Examiner*—Donnie L. Crosland
*Attorney, Agent, or Firm*—Wenderoth, Lind & Ponack

[57] ABSTRACT

In a fire-alarm system in which a plurality of terminal units are connected to a fire receiver via a main signal line, the fire receiver polls each terminal unit, and the terminal unit called by the polling sends a current signal back to the fire receiver. A voltage signal receiving circuit having a DC signal component blocker is provided in each terminal unit for removing a DC signal component of a polling signal so as to detect only an AC signal component of the polling signal, and a current signal transmitting circuit having a constant-current circuit is provided so that the constant-current circuit is turned on/off to deliver the return signal. Therefore, a threshold used for signal discrimination in the voltage signal receiving circuit can be easily set. The current consumed by the terminal unit becomes constant regardless of the number of the terminal units connected when it is outputting the current signal, resulting in the terminal unit not wastefully consuming an extra current.

14 Claims, 5 Drawing Sheets

FIRE-ALARM SYSTEM

BACKGROUND OF THE INVENTION

1. Field of the Invention

The present invention relates to a fire-alarm system in which a fire receiver polls a plurality of terminal units such as relay devices and analog fire detectors.

2. Description of the Related Art

There is known a fire-alarm system of the so-called polling type in which a fire receiver polls a plurality of terminal units such as relay devices to which equipment to be controlled, including fire detectors, local bells and smoke protecting and discharging equipment, are connected, and analog fire detectors for outputting signals of physical quantities on detected fire phenomena (heat, smoke, gas, etc.); the terminal unit called by the polling sends status information such as the presence or absence of a fire signal and signals of physical quantities back to the fire receiver, and the fire receiver informs and/or indicates an outbreak of a fire based on the status information returned.

FIG. 5 is a circuit diagram showing one example of conventional fire-alarm systems of the type mentioned above. In the diagram, denoted by RE is a fire receiver, T1, T2, . . . are relay devices as one example of terminal units, and L1 is a pair of main signal lines connecting the fire receiver RE and the relay devices T1, T2, . . . to transmit signals and a source voltage. The terminal units may include analog fire detectors for outputting signals of physical quantities on detected fire phenomena, and other suitable equipment.

The fire receiver RE comprises a voltage signal transmitting circuit TX1 for transmitting a polling signal to the relay devices T1, T2, . . . , a voltage signal receiving circuit RX1 for receiving return signals sent back from the relay devices T1, T2, . . . , a microcomputer MPU1 for outputting the polling signal to the transmitting circuit TX1 and for decoding and discriminating the return signals received by the receiving circuit RX1, and a constant-current circuit SC for restricting a current flowing through the main signal lines L1. The transmitting circuit TX1 comprises a constant-voltage circuit SVH for an H (high-level) signal which outputs a voltage VH of 30 V, for example, a constant-voltage circuit SVL for an L (low-level) signal which outputs a voltage VL of 24 V, for example, and a switch SW turned on/off under control of the MPU1 for connecting or disconnecting the constant-voltage circuit SVH for H signal to or from the main signal lines L1, respectively.

The relay devices T1, T2, . . . each comprise a voltage signal receiving circuit RX2 for receiving the polling signal from the fire receiver RE, a voltage signal transmitting circuit TX2 provided with a switching circuit SWC for transmitting the return signal, a microcomputer MPU2 for decoding the polling signal received by the receiving circuit RX2 and for outputting the return signal to the transmitting circuit TX2, a Zener diode ZD for preventing the line-to-line voltage of the pair of main signal lines L1 from lowering below a predetermined voltage while the transmitting circuit TX2 is under signal transmission, and a constant-voltage circuit SV. The relay device T1 further comprises a fire signal detecting circuit FR for detecting a fire signal from a fire detector DE such as a heat sensor or a smoke sensor, and a local sound control circuit CC for controlling the sound of a local bell B.

In the above conventional fire-alarm system of the polling type, the number of the terminal units connected to the fire receiver RE, such as the relay devices T1, T2, . . . and fire detectors, depends on the location where the fire-alarm system is installed. The current flowing through the main signal lines L1 is controlled to be kept constant by the constant-current circuit SC on the side of the fire receiver RE, but the current flowing through the terminal unit under signal transmission varies with the number of the terminal units connected. Compare, by way of example, the case that the number of the terminal units connected is 200 and the case that the number is 100.

The comparison is made on condition that a constant current value (limit current) of the constant-current circuit SC in the fire receiver RE is set to 450 mA and a monitoring current per relay unit is 2 mA, for example.

In the case that 200 terminal units are connected to the fire receiver RE, the current consumed by the terminal units under signal transmission is given by:

$$450\text{ mA}-(2\text{ mA}\times 200)=50\text{ mA}$$

In the case that 100 terminal units are connected to the fire receiver RE, the current consumed by the terminal units under signal transmission is given by:

$$450\text{ mA}-(2\text{ mA}\times 100)=250\text{ mA}$$

Thus, the current consumed by the terminal units under signal transmission varies greatly with the number of the terminal units connected in spite of the fact that the current flowing through the main signal lines L1 is kept constant by the constant-current circuit SC provided in the fire receiver RE. In the above example, assuming that the current required for the terminal units during signal transmission is 50 mA, the terminal units consume an extra current of 200 mA in a signal transmitting state, when the number of terminal units connected thereto is 100. Furthermore, the signal detected by a signal detecting resistor R1 of the voltage signal receiving circuit RX1 in the fire receiver RE varies to a large extent depending on the number of the relay devices, fire detectors and other terminal units connected thereto, making it very difficult to design a circuit involving an amplifier, a comparator, etc. of the voltage signal receiving circuit RX1 or to set a signal discriminating level.

Meanwhile, the fire receiver RE transmits the polling signal to the terminal units such as the relay devices T1, T2, . . . and fire detectors by switching the voltage supplied to the main signal lines L1 between the voltage VH and the voltage VL.

When those voltages VH and VL are supplied to the terminal units, their voltage values are dropped due to a line resistance R0 of the main signal lines L1. Assuming that such a voltage drop is DV and a voltage threshold required for the voltage signal receiving circuit RX2 in each of the relay devices T1, T2, . . . to discriminate the H signal and the L signal is Vth, $$(VH-DV)>Vth$$

must be satisfied for enabling the relay device to discriminate the H signal and the L signal. In other words, the line resistance R0 cannot exceed a predetermined value. Assuming that the voltages VH, VL, Vth are respectively 30 V, 24 V, 26 V, by way of example, with 2 V taken as an allowance for signal discrimination, $$VH-DV>Vth+2=26+2=28$$

must be satisfied.

It is also assumed that 200 terminal units such as relay devices and analog fire detectors, each requiring a supervisory current of 2 mA, are connected like the above example. In this case, the following equations hold:

$$DV=R0\times(0.002\times200)=0.4\times R0$$

$$VH-DV=30-0.4\times R0>28$$

hence R0<5(X)

Accordingly, in application to large-scaled fire-alarm systems (which include a large number of terminal units connected to the fire receiver, or which have the long main signal lines L1 ), it is required to reduce the current consumed by each of the terminal units, or raise the voltage VH, or make the line resistance R0 smaller, i.e., make the lines thicker, or lower the minimum operating voltage of the terminal unit. However, reducing the current consumed by the terminal unit or lowering the minimum operating voltage of the terminal unit has technical limitations. Also, it is difficult to achieve a smaller line resistance R0 with existing signal lines. Raising the voltage VH brings about a problem in that existing equipment can not be used.

In addition, conventional fire-alarm systems include no means for easily knowing whether the terminal unit actually receives the polling signal from the main signal lines L1, or whether the terminal unit actually transmits the polling signal to the main signal lines L1. Therefore, it is difficult to determine in the occurrence of an abnormal condition or which part has failed.

SUMMARY OF THE INVENTION

An object of the present invention is to provide a fire-alarm system of the polling type in which an excessive current will not flow through a terminal unit during signal transmission.

Another object of the present invention is to provide a fire-alarm system which can be easily adapted for a large-scaled system.

To achieve the above objects, the present invention is intended for a fire-alarm system in which a plurality of terminal units are connected to a fire receiver via a main signal line, said fire receiver polling each of said terminal units, and the terminal unit called by the polling sending a current signal back to said fire receiver; said fire receiver comprising;

a voltage source for outputting a DC voltage;

a voltage signal transmitting circuit for forming a polling signal by superposing a pulse signal having an AC component and a DC component over said DC voltage and for transmitting said polling signal to said main signal line; and a current signal receiving circuit for receiving a current signal transmitted from each of said terminal units; each of said terminal units comprising:

a voltage signal receiving circuit for blocking said DC signal component of said polling signal input via said main signal line and for detecting only said AC signal component of said polling signal, a signal processing circuit for receiving said AC signal component of said polling signal detected by said voltage signal receiving circuit and for producing a pulse code signal representative of return information to be sent back to said fire receiver, and a current signal transmitting circuit for transmitting a current signal of predetermined current to said main signal line in accordance with the pulse code signal of said return information produced by said signal processing circuit.

DESCRIPTION OF THE PREFERRED EMBODIMENTS

Hereinafter, a first embodiment of the present invention will be described with reference to FIGS. 1 and 2.

Figure 1:
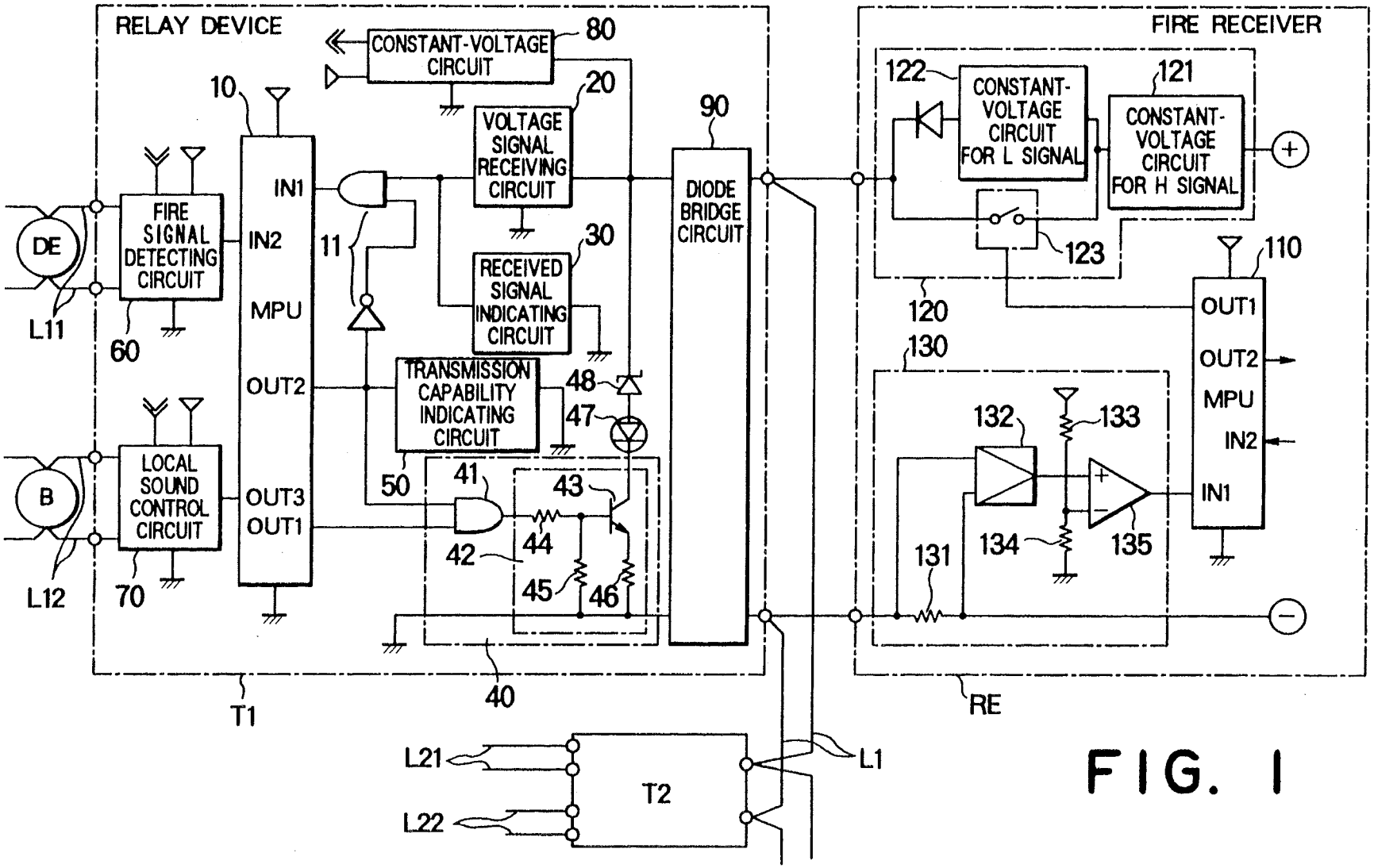
Fig. 1 is a block diagram showing a fire-alarm system according to a first embodiment of the present invention.

In FIG. 1, RE is a fire receiver, T1, . . . T2, . . . are relay devices, DE . . . is a fire detector, and B . . . is a local bell. L1 is a pair of main signal lines connecting the fire receiver RE and the relay devices T1, . . . T2, . . . to transmit signals and a source voltage. L11, . . . L21, . . . are each a pair of local signal lines connecting the relay devices T1 and T2, . . . and the fire detectors DE . . . to transmit signals and a source voltage. L12, . . . L22, . . . are each a pair of local control lines connecting the relay devices T1, . . . T2, . . . and the local bells B . . . .

The fire receiver RE comprises a microcomputer (hereinafter referred to as an MPU) 110 used as a signal processing circuit, a voltage signal transmitting circuit 120 for transmitting a voltage signal to the relay devices T1, T2, . . . , a current signal receiving circuit 130 for receiving current signals transmitted from the relay devices T1, T2 . . . , and other components, though not shown, such as an indicating circuit having fire area indicators and various indicator lamps, a manipulation entry circuit having a fire reset switch and various manipulation switches, a main bell, and a power supply circuit.

The voltage signal transmitting circuit 120 comprises a constant-voltage circuit 121 an H (high-level) signal which outputs an H signal of 30 V, for example, a constant-voltage circuit 122 for an L (low-level) signal which outputs an L signal of 24 V, for example, and a switching circuit 123 in the form of an analog switch, for example, turned on/off by a transmission signal (pulse code) output from an output port OUT1 of the MPU 110.

The current signal receiving circuit 130 for receiving current signals comprises a signal detecting resistor 131, an amplifier 132 for amplifying a voltage across the resistor 131, dividing resistors 133 and 134 for generating a reference voltage used in discriminating the received signal, and a comparator 135 for comparing an output of the amplifier 132 and the reference voltage.

The relay device T1 comprises an MPU 10 used as a signal processing circuit, a voltage signal receiving circuit 20 for receiving the voltage signal transmitted from the fire receiver RE, a received signal indicating circuit 30 for making an indicator lamp flash on/off depending on a signal status of the received signal, a current signal transmitting circuit 40 provided with a constant-current circuit 42 for transmitting the current signal to the fire receiver RE, a transmitted signal indicating lamp 47 flashing on/off depending on a signal status of the transmitted signal, a Zener diode 48 for holding the line-to-line voltage of the pair of main signal lines L1 at a predetermined voltage necessary for the terminal unit to maintain its operation when the transmitting circuit 40 is under signal transmission, a transmission capability indicating circuit 50 for indicating that the current signal transmitting circuit 40 is in a state capable of transmission, and a gate circuit 11 comprised of an AND circuit and an inverter circuit.

The relay device T1 further comprises a fire signal detecting circuit 60 for detecting a fire signal sent from a fire detector DE connected to the relay device T1 via the local line L11, a local sound control circuit 70 for controlling the sound of the local bell B connected to the relay device T1 via the local control line L12, a constant-voltage circuit 80 for converting a source voltage supplied from the fire receiver RE via the main signal lines L1 into voltages required for the circuits in the relay device T1 and the fire detector DE and for supplying those voltages, and a diode bridge circuit 90 for making the signals free from polarity.

Figure 2:
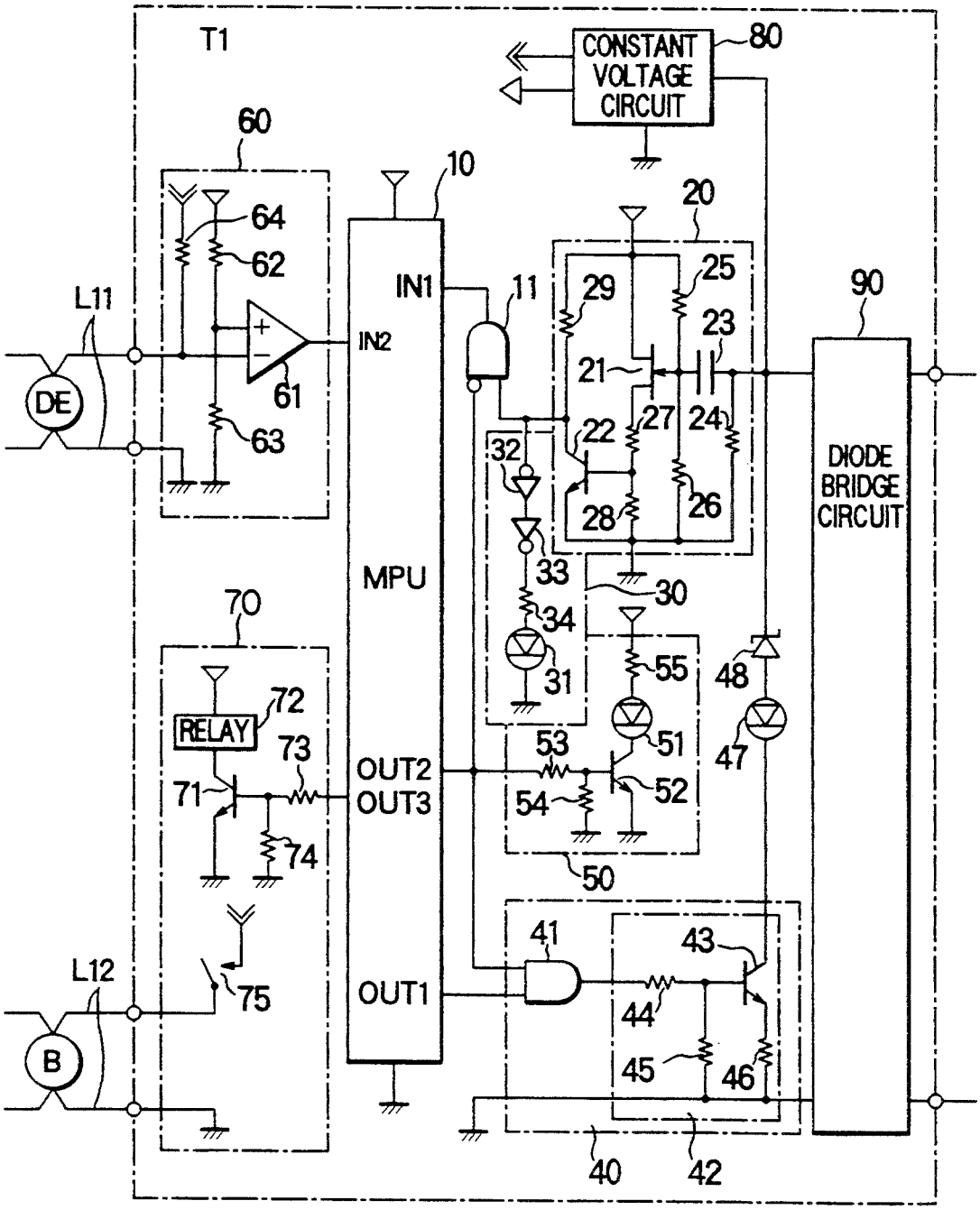
FIG. 2 is a circuit diagram showing the internal configuration of a relay device shown in FIG. 1.

The receiving circuit 20 comprises, as shown in FIG. 2, a field effect transistor (FET) 21, a transistor 22, a capacitor 23, and resistors 24 to 29. The capacitor 23 serves as a DC signal component blocker means for blocking a DC signal component and allowing an AC signal component to pass therethrough.

A received output of the receiving circuit 20 is applied to a received signal input port IN1 of the MPU 10 via one input terminal of the AND circuit of the gate circuit 11. Connected to the other input terminal of the AND circuit of the gate circuit 11 is an enable signal output port OUT2 of the MPU 1O via an inverter.

The received signal indicating circuit 30 comprises a light emitting diode 31 as a received signal indicating lamp, inverters 32 and 33 connected in series, and a resistor 34.

The current signal transmitting circuit 40 comprises an AND circuit 41 connected across a transmitted signal output port OUT1 and the enable signal output port OUT2 of the MPU 10, as well as a constant-current circuit 42 composed of a transistor 43 and resistors 44 to 46.

The transmission capability indicating circuit 50 comprises a light emitting diode 51 as a transmission capability indicating lamp, a transistor 52, and resistors 53 to 55, the circuit 50 being connected to the enable signal output port OUT2 of the MPU 10.

The fire signal detecting circuit 60 comprises a comparator 61 for detecting the fire signal, dividing resistors 62 and 63 for generating a reference voltage used in discriminating the fire signal, and a resistor 64. Further, though not shown, a termination resistor is provided at an end of the local line L11 and the relay device T1 includes a disconnection detecting circuit for detecting a disconnection of the local line L1.

The local sound control circuit 70 comprises a transistor 71, a control relay 72, resistors 73 and 74, and a make contact 75 of the relay 72, the circuit 70 being connected to a control signal output port OUT3 of the MPU 10.

Note that each of the other relay devices T2, . . . connected to the fire receiver RE is the same arrangement as the relay device T1 and, therefore, their circuit diagrams have not been illustrated.

Figure 3:
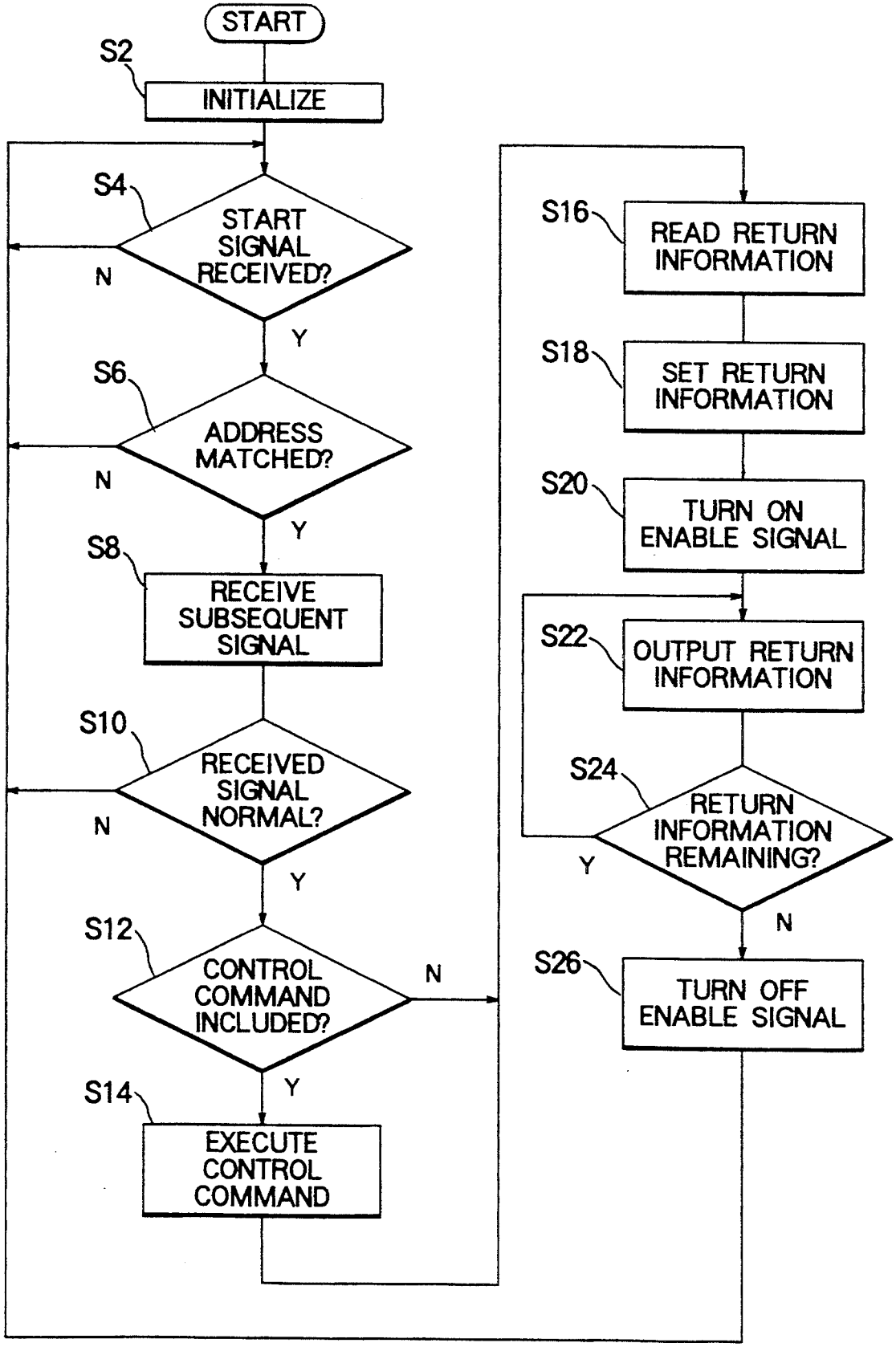
FIG. 3 is a flowchart showing operation of the first embodiment.

The operation of the present fire-alarm system will be described below with reference to the flowchart of FIG. 3. The flowchart of FIG. 3 is a flowchart for programs stored in the MPU 10 of each of the relay devices T1, T2, . . . .

The fire receiver RE outputs a serial code pulse signal for polling from a polling signal output port OUT1 of the MPU 110. The switching circuit 123 is turned on/off depending on a level of the pulse signal. More specifically, when the output port OUT1 outputs an H (high-level) signal, the switching circuit 123 is turned on for delivering the output voltage of the constant-voltage signal 121 for an H signal to the main signal lines L1, and when the output port OUT1 outputs an L (low-level) signal, the switching circuit 123 is turned off for delivering the output voltage of the constant-voltage circuit 122 for an L signal to the main signal lines L1. In this manner, the polling signal is delivered from the voltage signal transmitting circuit 120 of the fire receiver RE to the main signal lines L1.

On the side of the relay device T1, when the source voltage is supplied from the fire receiver RE via the pair of main signal lines L1, the MPU 10 performs initial procedures, i.e., initialization, in step S2.

Next, when the voltage signal receiving circuit 20 receives the polling signal delivered from the fire receiver RE, the receiving circuit 20 produces a low-level output when the received signal is at a high level, and a high-level output when the received signal is at a low level. The output signal thus produced from the receiving circuit 20 is applied to the received signal input port IN1 of the MPU 10 via the gate circuit 11. The received signal indicating lamp 31 of the received signal indicating circuit 30 is lit up by the high-level output of the receiving circuit 20 and turned off by the low-level output of the same.

Thus, the indicating lamp 31 flashes on/off depending on the signal status of the received signal.

In step S4, the MPU 10 determines whether or not the received signal applied to the input port IN1 is a start signal. If it is a start signal, then the MPU 10 determines in step S6 whether or not a subsequent address signal matches its own address. If the subsequent address signal matches its own address, then the MPU 10 receives a further subsequent signal such as a command signal in step S8. After completely receiving the subsequent signal, the MPU 10 determines in step S10 whether or not the received signal from the fire receiver RE is normal, by using a sum check code or a CRC code, for example.

If the received signal is normal, then the MPU 10 determines in step S12 whether or not a control command is included in the received signal. If the control command exists, then the MPU 10 executes the control command in step S14. For example, when the control command is a local sound start command, the MPU 10 outputs a high-level signal from the control signal output port OUT3. The relay 72 of the control circuit 70 is thereby actuated to close the make contact 75, causing the local bell B to start ringing. When the control command is a sound stop command, the MPU 10 outputs a low-level signal from the control signal output port OUT3. The relay 72 of the control circuit 70 is thereby released to open the make contact 75, causing the local bell B to stop ringing. When the control command is a reset command, the MPU 10 turns off a not-shown switch temporarily to cut off supply of the source voltage to the local line L11 for resetting the fire detector DE once operated and, at the same time, outputs a low-level signal from the control signal output port OUT3, causing the local bell B to stop ringing.

After completely executing the control command, or if no control command is included in the received signal, then the MPU 10 reads in step S16, as return information, the presence or absence of the fire signal from a fire signal input port IN2, and sets the return information into a return register (not shown) in step S18 along with its own address, etc. While the return information indicates the presence or absence of the fire signal in this embodiment, it may also include other items such as whether or not the local line L11 is disconnected, and whether or not the local bell B is ringing or not or not, in addition to the presence or absence of the fire signal.

After completely setting the return information, the MPU 10 outputs a high-level signal from the enable signal output port OUT2, i.e., turns on an enable signal, in step S20. The transmission capability indicating lamp 51 of the transmission capability indicating circuit 50 is lit up by the high-level output from the output port OUT2 to indicate that the current signal transmitting circuit 40 is in a state capable of transmission. Simultaneously, the high-level output from the output port OUT2 inhibits operation of the AND circuit of the gate circuit 11, thereby inhibiting the received output of the receiving circuit 20 from being applied to the input port IN1.

Next, the MPU 10 outputs the return information in the form of a serial code signal from the transmitted signal output port OUT1 to the transmitting circuit 40 in step S22. The transistor 43 of the transmitting circuit 40 is turned on when the input signal is at a high level, and turned off when it is at a low level. When the transistor 43 is turned on, the transmitting circuit 40 delivers a predetermined current, as an H signal, to the main signal lines L1 through the operation of making the current constant in the constant-current circuit 42 comprised of the transistor 43 and the resistors 44 to 46. While the transistor 43 is kept turned on for delivering the H signal to the main signal lines L1, the transmitted signal indicating lamp 47 continues to light up. Incidentally, when the H signal is being delivered, the line-to-line voltage of the main signal lines L1 is held at a predetermined voltage by the Zener diode 48.

Upon determining in step S24 that the return information has been completely delivered, the MPU 10 sets the output from the output port OUT2 to a low level, i.e., turns off the enable signal, in next step S26. Correspondingly, the transmission capability indicating lamp 51 is turned off and the gate circuit 11 restored to a state capable of operation, thus allowing the received output of the receiving circuit 20 to be applied to the input port IN1 of the MPU 10.

In the fire receiver RE, the current signal receiving circuit 130 detects the current signal in the form of H and L signals delivered from each of the relay devices T1, T2, . . . . In the receiving circuit 130, when the voltage drop produced across the signal detecting resistor 131 is larger than a predetermined voltage, the comparator 135 outputs a high-level signal to a signal input port IN1 of the MPU 110, and when it is smaller than the predetermined voltage, the comparator 135 outputs a low-level signal. If the fire signal is present in the return information received from the relay device through the receiving circuit 130, the MPU 110 determines the fire area and outputs a signal representative of the fire area to an indication unit (not shown), thereby issuing an alarm.

Meanwhile, the voltage signal receiving circuit 20 of the relay device detects a differential voltage between a level of the H signal and a level of the L signal which corresponds to an AC component of the polling signal. More specifically, assuming that the H signal is at a level of 30 V and the L signal is at a level of 24 V, the differential voltage of 6 V is an AC component of the polling signal and can pass through the capacitor 23. However, since there occurs a voltage drop DV due to the line resistance of the main signal lines L1, the AC signal voltage of (6−DV) V actually passes through the capacitor 23. Further, since the voltage signal passing through the capacitor 23 includes no DC components, the L signal having passed through the capacitor 23 can be always made zero as a result of its DC component being cut. This makes it easier to set the fixed threshold Vth, which manages the on/off operation of the FET 21, by the resistors 25 and 26. Additionally, the FET 21 is turned on when the high-level signal (about 6 V) is applied through the capacitor 23, and the receiving circuit 20 outputs a low-level signal resulted from inverting the input signal. On the contrary, the FET 21 is turned off when the low-level signal (0 V) is applied, and the receiving circuit 20 outputs a high-level signal.

Furthermore, when the MPU 10 is not outputting the enable signal from the output port OUT2, the transistor 43 is not turned on and the current signal transmitting circuit 40 does not output any signal. When the MPU 10 outputs a high-level signal from the output port OUT1 while outputting the enable signal from the output port OUT2, the output of the AND circuit 41 becomes a high level and, with this high-level output, the transistor 43 is turned on so that a high-level current signal flows to the main signal lines L1. At this time, the constant-current circuit 42 comprised of the transistor 43 and the resistors 44 to 46 performs the operation of making the current constant, whereby the high-level signal current flowing through the main signal lines L1 is held down to a constant current, e.g., 50 mA. On the other hand, when the MPU 10 outputs a low-level signal from the output port OUT1, the output of the AND circuit 41 becomes a low level and, with this low-level output, the transistor 43 is turned off so that a low-level current signal of 2 mA flows to the main signal lines L1. Accordingly, when any of the terminal units such as the relay devices T1 . . . and the analog fire detectors is delivering the return signal, no excessive current flows through the terminal unit. In addition, since the high-level signal current delivered from each terminal unit is constant regardless of the number of the terminal units connected to the main signal lines, it is very easy to set the reference voltage used in discriminating the received signal by the dividing resistors 133 and 134 in the receiving circuit 130 of the fire receiver RE.

Moreover, the received signal indicating lamp 31 is caused to flash on/off depending on the received signal of the receiving circuit 20, the transmission capability indicating lamp 51 is caused to light up by the enable signal which sets the transmitting circuit 40 into a state capable of transmission, and further the transmitted signal indicating lamp 47 is caused to flash on/off depending on the transmitted signal delivered from the transmitting circuit 40. Accordingly, when the terminal unit does not respond to the polling signal from the fire receiver, whether the faulty part locates in the receiving circuit 20 or downstream of the receiving circuit 20 can be judged by determining whether or not the received signal indicating lamp 31 flashes on/off periodically. Also, whether an abnormality exists in the transmitting circuit 40 or on the side of the MPU 10 can be judged by determining whether or not the transmitted signal indicating lamp 47 and the transmission capability indicating lamp 51 are lit up.

Figure 4:
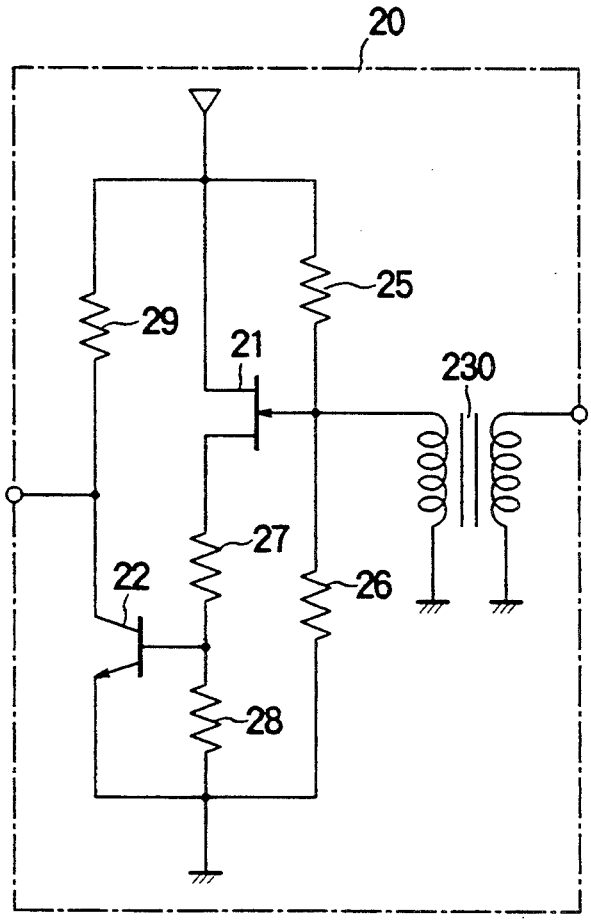
FIG. 4 is a circuit diagram showing a voltage signal receiving circuit used in the relay device according to a second embodiment.
Figure 5:
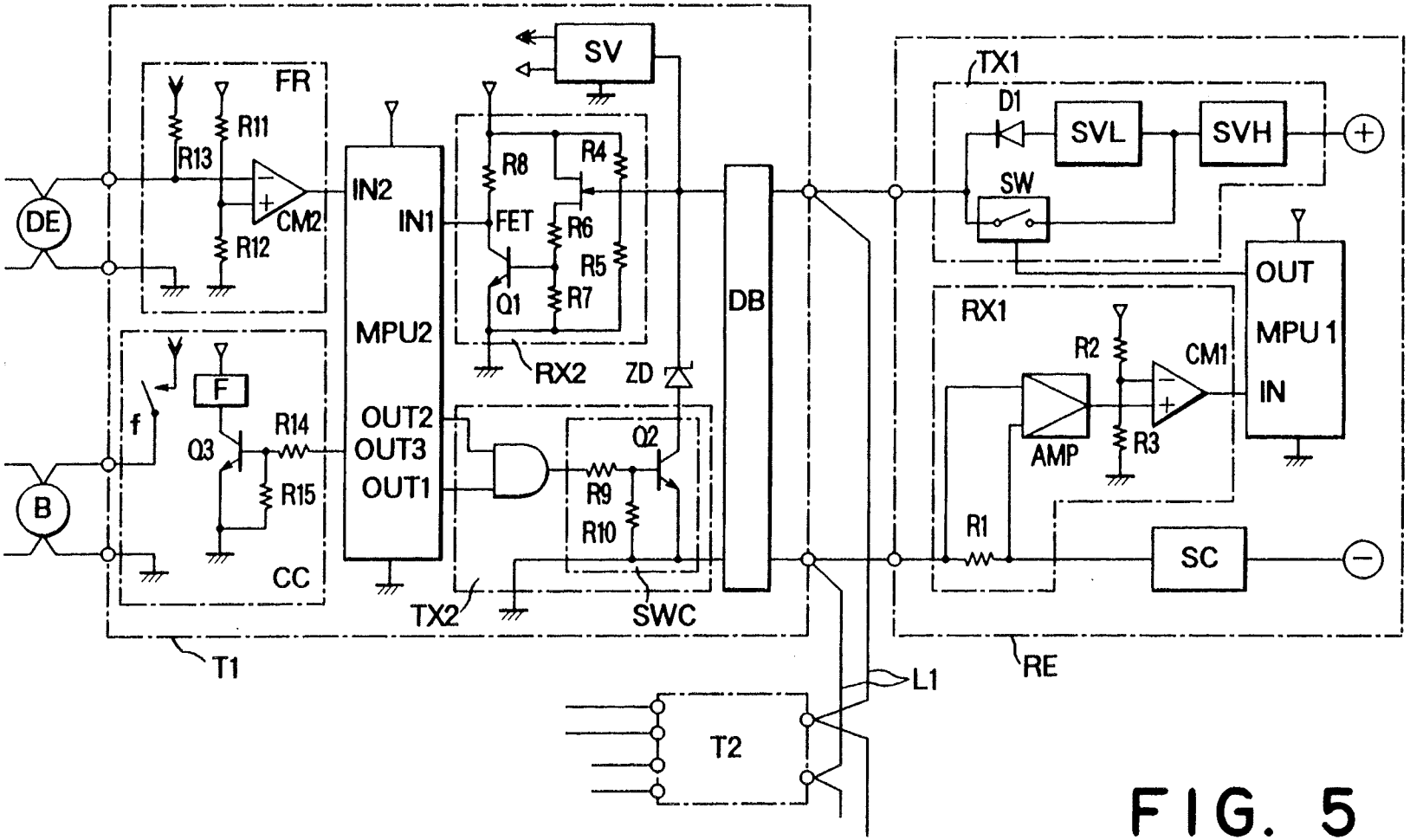
FIG. 5 is a block diagram showing a conventional fire-alarm system.

FIG. 4 shows a voltage signal receiving circuit 20 in the relay device according to a second embodiment. This receiving circuit 20 is different from the receiving circuit 20 shown in FIG. 2 in that an isolation transformer 230 is used as the DC signal component blocker in place of the capacitor 23. The remaining arrangement is the same as FIG. 2. The transformer 230 operates in such a way that when the polling signal is input to a primary winding, a pulse signal corresponding to an AC signal component of the polling signal is produced in a secondary winding. At this time, the transformer 230 cuts a DC signal component of the polling signal over which the pulse signal is superposing. As with the first embodiment, therefore, it is easy to set the fixed threshold used in discriminating the H signal and the L signal. Additionally, if the number of turns of the secondary winding is set larger than that of the primary winding of the transformer 230, the AC signal component can be amplified.

While the above embodiments have been described as using the relay device as the terminal unit, the arrangement shown in FIG. 2 is modified as follows in the case of the terminal unit being of an analog fire detector. In place of the fire signal detecting circuit 60, there are provided a smoke sensor of the light scattering type or the ionization type which detects smoke and outputs an analog quantity, or a heat sensor such as a thermistor which detects heat and outputs an analog quantity, and an analog-to-digital converter for converting the analog output of the smoke sensor or the heat sensor into a digital signal. In addition, the local sound control circuit 70 is omitted. The remaining circuit configuration is the same as the relay device. The MPU 10 reads the digital signal output from the analog-to-digital converter through the input port, and the read digital signal is delivered to the fire receiver RE through the transmitting circuit 40.

According to the present invention, as fully described above, a voltage signal receiving circuit having a DC signal component blocker is provided in a terminal unit such as a relay device or a fire detector for removing a DC signal component of the polling signal to detect only an AC signal component of the polling signal, and a current signal transmitting circuit having a constant-current circuit is provided so that the constant-current circuit is turned on/off to deliver the return signal. Therefore, a threshold used for signal discrimination in the voltage signal receiving circuit can be easily set. The current consumed by the terminal unit becomes constant regardless of the number of the terminal units connected when it is outputting the return signal, resulting in the terminal unit not wastefully consuming an extra current. This means that the present fire-alarm system can be easily adapted for large-scaled systems.

Also, while the terminal unit is outputting the return signal, the enable signal inhibits the received signal of voltage signal receiving circuit from being applied to a signal processing circuit. Therefore, the signal processing circuit will not malfunction due to the return signal delivered from itself.

Further, with the provision of a received signal indicating lamp lit up by the received signal of voltage signal receiving circuit, whether or not the failed part locates upstream of the receiving circuit or downstream of the signal processing circuit can be judged based on whether or not the received signal indicating lamp is lit up.

In addition, since a transmission capability indicating lamp lit up by the enable signal and a transmitted signal indicating lamp lit up by the transmitted signal are provided, any abnormality in the transmitting circuit or the signal processing circuit can be judged by noting whether or not those lamps are lit up.

What is claimed is:

1. A fire-alarm system in which a plurality of terminal units are connected to a fire receiver via a main signal line, said fire receiver polling each of said terminal units, and the terminal unit called by the polling sending a current signal back to said fire receiver, said fire receiver comprising:

a voltage source for outputting a DC voltage;

a voltage signal transmitting circuit for forming a polling signal having an AC signal component and a DC signal component by superposing a pulse signal over said DC voltage and for transmitting said polling signal to said main signal line; each of said terminal units comprising:

a voltage signal receiving circuit for blocking said DC signal component of said polling signal input via said main signal line and for detecting only said AC signal component of said polling signal;

a signal processing circuit for receiving said AC signal component of said polling signal detected by said voltage signal receiving circuit and for producing a pulse code signal representative of return information to be sent back to said fire receiver; and a current signal transmitting circuit for transmitting a current signal of predetermined current to said main signal line in accordance with the pulse code signal of said return information produced by said signal processing circuit.

2. A fire-alarm system according to claim 1, wherein said main signal line comprises a pair of lines; and wherein each of said terminal units includes voltage holder connected to said current signal transmitting circuit for holding a line-to-line voltage of said pair of lines of said main signal line at a predetermined value during transmission of said current signal.

3. A fire-alarm system according to claim 2, wherein said voltage holder is a Zener diode.

4. A fire-alarm system according to claim 1, wherein said voltage signal receiving circuit includes a DC signal component blocker for blocking said DC signal component of said polling signal and for allowing only said AC signal component of said polling signal to pass therethrough.

5. A fire-alarm system according to claim 4, wherein said DC signal component blocker is a capacitor.

6. A fire-alarm system according to claim 4, wherein said DC signal component blocker is an isolation transformer.

7. A fire-alarm system according to claim 1, wherein each of said terminal units includes a transmitted signal indicating lamp connected to said current signal transmitting circuit and caused to flash on/off depending on a signal status of said current signal transmitted by said current signal transmitting circuit.

8. A fire-alarm system according to claim 1, wherein said signal processing circuit in each of said terminal units outputs an enable signal when said signal processing circuit is producing the pulse code signal of said return information.

9. A fire-alarm system according to claim 8, wherein said current signal transmitting circuit in each of said terminal units includes an AND circuit for computing a logical product of the pulse code signal of said return information and said enable signal, and a constant-current signal for delivering the current signal of constant current to said main signal line depending on an output level of said AND circuit.

10. A fire-alarm system according to claim 8, wherein each of said terminal units includes a gate circuit connected between said voltage signal receiving circuit and said signal processing circuit for inhibiting the signal detected by said voltage signal receiving circuit from being input to said signal processing circuit when said signal processing circuit is outputting said enable signal.

11. A fire-alarm system according to claim 8, wherein each of said terminal units includes a transmission capability indicating lamp caused to flash on/off depending on said enable signal output from said signal which is processing circuit.

12. A fire-alarm system according to claim 1, wherein each of said terminal units includes a received signal indicating lamp connected to said voltage signal receiving circuit and caused to flash on/off depending on a signal status of a signal detected by said voltage signal receiving circuit.

13. A fire-alarm system according to claim 1, wherein each of said terminal units includes a fire signal detecting circuit connected to said signal processing circuit and an external fire detector, said external fire outputting a fire signal, and wherein said fire signal outputted by said fire detector is supplied to said signal processing circuit.

14. A fire-alarm system according to claim 1, wherein each of said terminal units includes a local sound control circuit connected to said signal processing circuit and an external local bell, and wherein said local bell is actuated by said local sound control circuit based on a signal output from said signal processing circuit.

* * * * *